US010493616B2

(12) United States Patent
Billups, Jr.

(10) Patent No.: US 10,493,616 B2
(45) Date of Patent: Dec. 3, 2019

(54) LOCK-IT-SOCKET HOLDER

(71) Applicant: William Lawrence Billups, Jr., Glen Allen, VA (US)

(72) Inventor: William Lawrence Billups, Jr., Glen Allen, VA (US)

( * ) Notice: Subject to any disclaimer, the term of this patent is extended or adjusted under 35 U.S.C. 154(b) by 0 days.

(21) Appl. No.: 16/179,687

(22) Filed: Nov. 2, 2018

(65) Prior Publication Data

US 2019/0070723 A1 Mar. 7, 2019

Related U.S. Application Data

(63) Continuation-in-part of application No. 15/046,754, filed on Feb. 18, 2016, now Pat. No. 10,118,287.

(60) Provisional application No. 62/176,412, filed on Feb. 19, 2015, provisional application No. 62/764,984, filed on Aug. 20, 2018.

(51) Int. Cl.
*B25H 3/00* (2006.01)

(52) U.S. Cl.
CPC ..... *B25H 3/003* (2013.01)

(58) Field of Classification Search
CPC ..... A47F 5/0846; A47F 7/0028; B25B 13/06; B25B 13/56; B25H 3/00; B25H 3/003; B25H 3/04; B25H 3/06
USPC ..... 211/69, 69.5, 69.6, 70.6; 206/372, 378
See application file for complete search history.

(56) References Cited

U.S. PATENT DOCUMENTS 5,228,570 A * 7/1993 Robinson ..... B25H 3/06 206/375
5,398,823 A * 3/1995 Anders ..... B25H 3/003 206/378
5,467,874 A * 11/1995 Whitaker ..... B25B 23/0035 206/378
5,715,951 A * 2/1998 Dembicks ..... B25B 13/56 206/378
6,386,363 B1 * 5/2002 Huang ..... B25H 3/003 206/1.5
6,431,373 B1 * 8/2002 Blick ..... B25H 3/003 206/378
6,991,105 B2 * 1/2006 Winnard ..... B25H 3/003 206/378
7,152,747 B2 * 12/2006 Wang ..... A47F 5/0006 211/70.6
8,556,075 B1 * 10/2013 Ou ..... B65D 73/0064 206/372
2005/0221664 A1 * 10/2005 Winnard ..... B25H 3/003 439/510
2010/0065520 A1 * 3/2010 Hsieh ..... B25H 3/06 211/70.6
2011/0089126 A1 * 4/2011 Hsieh ..... B25H 3/003 211/70.6

(Continued)

*Primary Examiner* — Joshua E Rodden

(57) ABSTRACT

A socket holder with a built in locking mechanism that is user controlled and activated by a push button which controls internal locking mechanism which allow this socket holder to securely store and transport sockets mounted to it. This socket holder can hold multiples of the sockets to its main socket holder body, releasing them only when desired by the user with the push of the push button that controls the internal mechanisms which release the sockets from the socket holder body. This socket holder is designed to organize and securely lock the sockets onto its socket holder body in a way that is dependable and easy to use.

14 Claims, 18 Drawing Sheets

(56) References Cited

U.S. PATENT DOCUMENTS

| | | | | |
|---|---|---|---|---|
| 2012/0061339 | A1* | 3/2012 | Chang | A47F 5/0006 211/70.6 |
| 2014/0260826 | A1* | 9/2014 | Eggert | B25B 23/0035 81/124.6 |
| 2016/0096264 | A1* | 4/2016 | Kao | B25H 3/06 206/378 |

* cited by examiner

LOCK-IT-SOCKET HOLDER

CROSS REFERENCE TO RELATED APPLICATIONS

This application is a continuation in part of application Ser. No. 15/046,754, filed on Feb. 18, 2016, which claims benefit of provisional 62/176,412 filed on Feb. 19, 2015.

This application also claims benefit of provisional application 62/764,984 filed on Aug. 20, 2018.

STATEMENT REGARDING FEDERALLY SPONSORED RESEARCH OR DEVELOPMENT (IF APPLICABLE)

"Not Applicable"

REFERENCE TO SEQUENCE LISTING, A TABLE, OR A COMPUTER PROGRAM LISTING COMPACT DISC APPENDIX (IF APPLICABLE)

"Not Applicable"

BACKGROUND OF THE INVENTION

The field of endeavor being discussed relates to tools and equipment that use "sockets" such as mechanics sockets in automobile repairs, aircraft and machinery. Even more particular to the actual "holders of these sockets".

The "socket holder" being very important as these sockets come is a multiple of different sizes and a multiple of different connecting drive sizes. This makes the need for a reliable holder with this new locking mechanism a feature and a necessity that has not been previously there for the user and the lack of it not being there the cause of much frustration, confusion and wasted time looking for these many different sockets while working on jobs requiring use of these sockets.

With many different size sockets with their different drive sizes not being kept in decent order with a secure and reliable way has been the reason for much confusion and wasted time. (Example) ¼" ⅜" ½" ¾" 1" and above drive sizes for sockets, with each size drive of a socket having many working size ends that go onto each set. This is why it is very important to have a secure, easy to use socket holder with designated spaces fear each socket on a lockable socket storage holder device.

Again the background of the invention comes from the need of: NOT having a strong and secure way to easily lock mount and dismount tool sockets onto a socket holder in a reliable, easy to use kind of way for use and transport of said sockets.

In the past the previous way of carrying these tool sockets for many people was to just put them in a box or a bag, making these sockets very hard to access easily and quickly; and causing great frustration for many when looking for said sockets when they were needed on any particular job where a socket or a multiple of different size sockets was needed.

For the most part it seemed the only time set of sockets in order and easy to find was when they just came in the box or in the shipping container from the manufacturer of these said sockets.

Using this secure and lockable socket holder device will maintain these sockets in their organized holding spaces on the socket holder dependably.

Keeping these different size drive and sized sockets in their respective holder spaces securely and dependably according to their ascending or descending size order will enable quick and easy access to them when they needed.

BRIEF SUMMARY OF INVENTION

The invention claimed here is called a Lock-it-Socket holder and is designed to securely hold a multiple amount of various sized sockets with various sized drives to its main socket holder body which is made and molded out of a hard resin or any desired material such as steel, brass, etc. and it does come with a user controlled internal locking mechanism on each of its designated socket holder mountings all of which are controlled by a push button.

The main feature of this socket holder being its ability to hold sockets onto its main socket holder body, with various internal parts working together to create a strong and reliable socket holding internal locking mechanism on each of its designated individual socket holder mountings, which are on the main socket holder body, holding sockets securely onto its main socket holder body in their designated size socket holder mounting spaces places, being released only when and with the press of the user controlled push button.

With the simple press of the push button, multiples of sockets can be placed on or off of the main socket holder body quickly and easily as needed while being held in their designated size individual socket holder mounting spaces securely.

Sockets will always be organized and ready for work when they are needed with this dependable and easy to use Lock-it-Socket holder.

Figure 1:
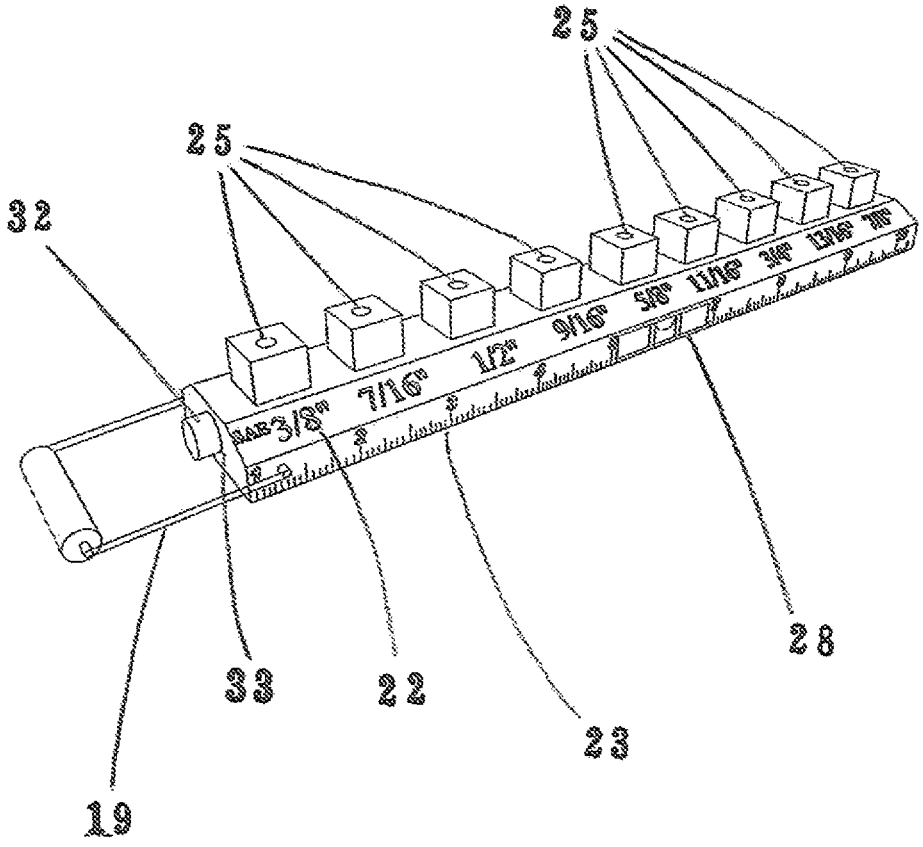
FIG. 1 Is a view of the lock-it-socket holder with the basic push button (32), handle (19), bubble level (28), socket holder size space markings sae and metric or as desired (22) ruler markings inches and metric (23) basic push button opening on main body (33) push rod relief holes (25).
Figure 2:
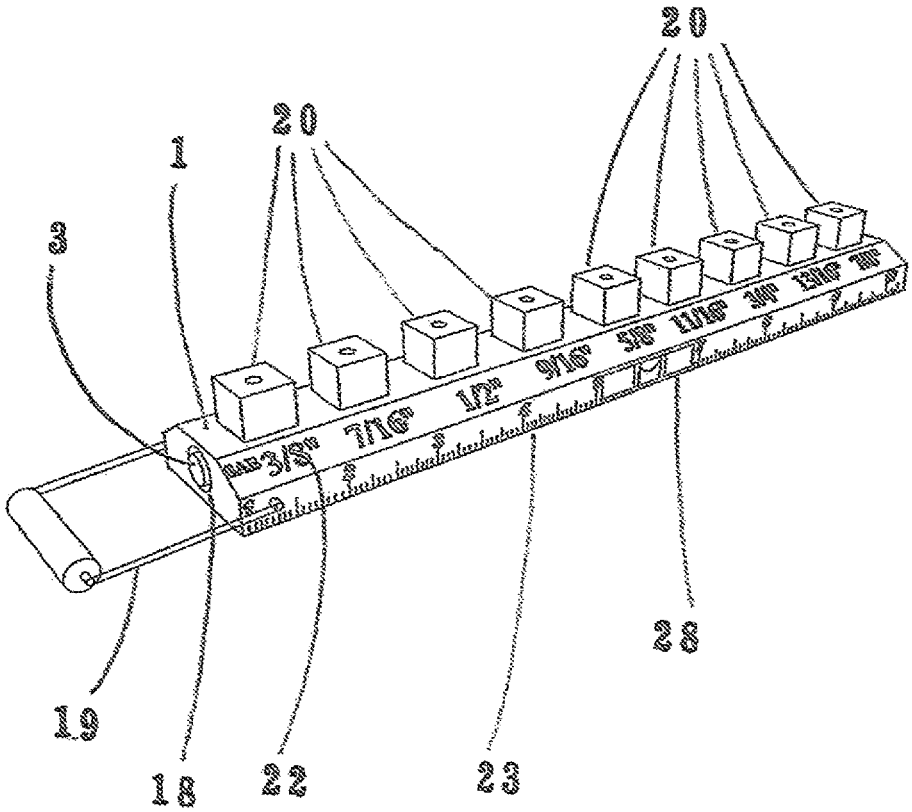
FIG. 2 Is a view of the lock-it-socket holder main socket holder body (1) with the push button recessed (3) in the recessed push button opening in the main body (18) handle (19) with socket holder mountings (20) socket holder size space markings sae and metric or as desired (22) ruler markings inches and metric (23) bubble level (28).
Figure 3:
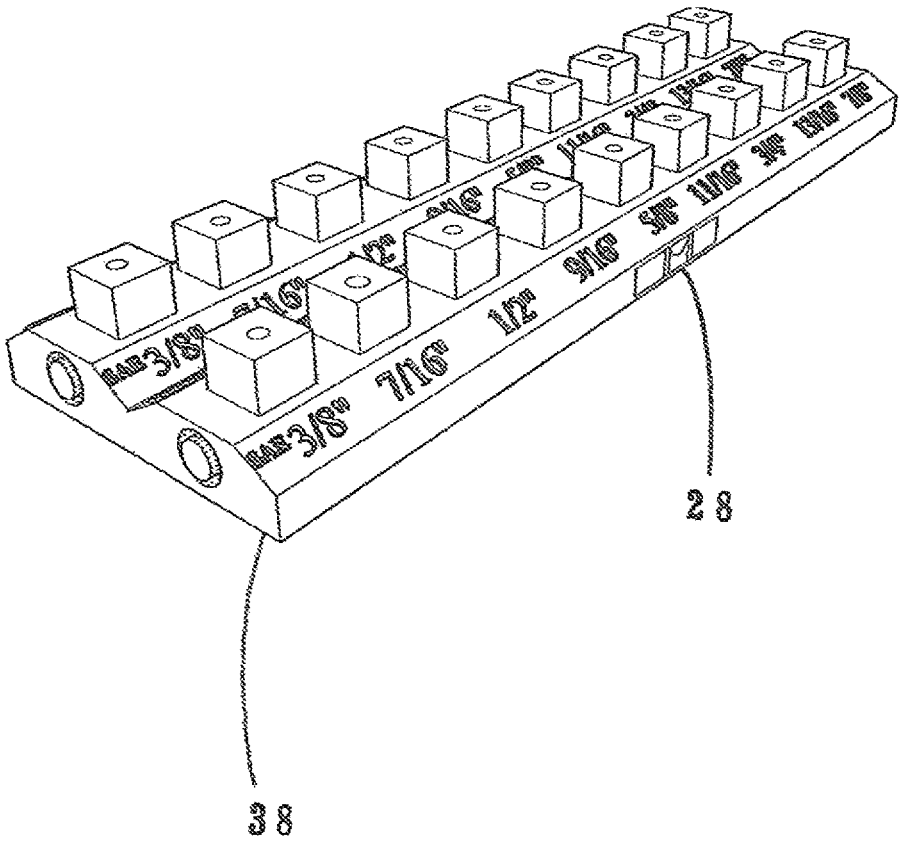
FIG. 3 Is a view of the lock-it-socket holder with a multiple release push button body (38) and bubble level (28).
Figure 4:
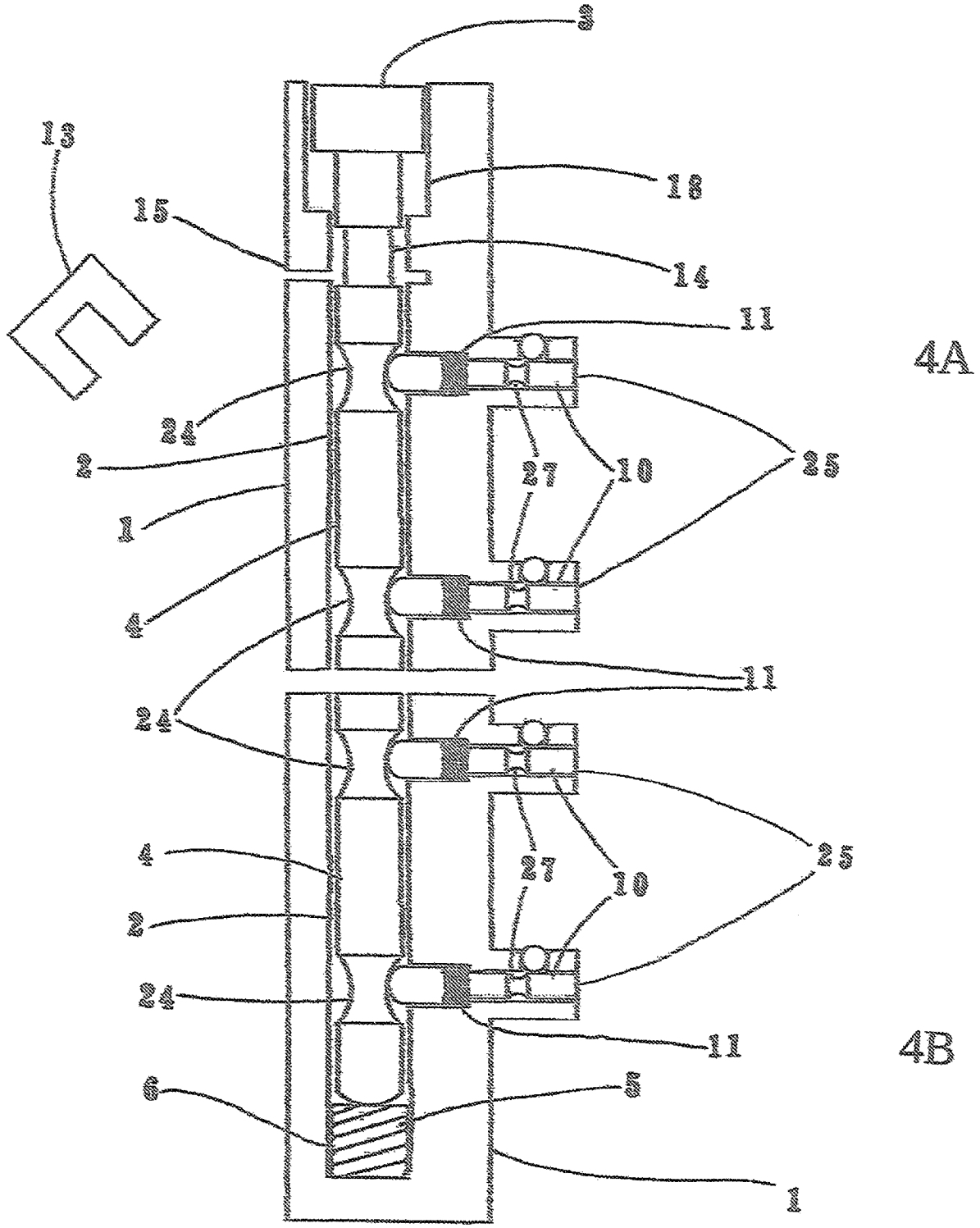
FIG. 4 Is a cross sectional view of the upper section 4A and lower section 4B parts of the lock-it-socket holder main socket holder body (1) showing how its internal parts meet and interact with each other along with the interacting of the control rod lock key (13) and the main body control rod lock key notch (15) with the main release control rod (4) and its control rod lock notch (14) along with many other parts as shown and numbered in the drawing.
Figure 5:
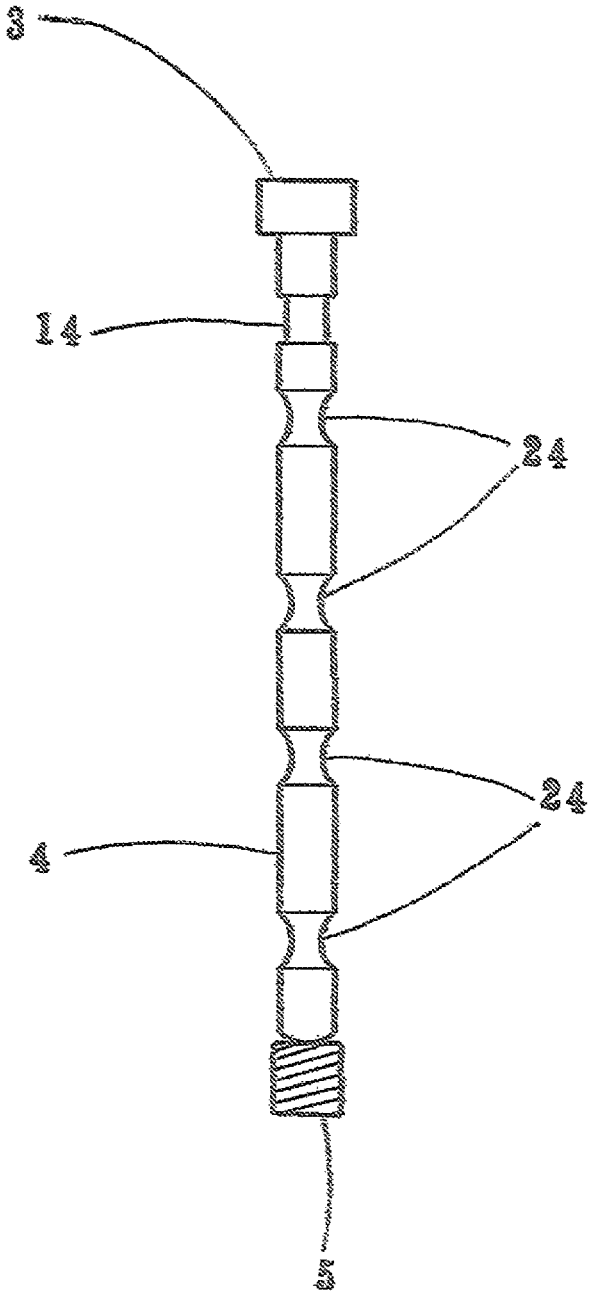
FIG. 5 Is a view of the lock-it-socket holder main release control rod (4) showing a push button recessed (3) end on the top end of the main release control rod (4) on which end it also serves as the basic push button (32) on the version of the main socket holder body (20) where the push button is exposed outside of the main socket holder body (1) and at the other end of the main release control rod (4) is where it goes against a main spring (5) also shown is the control rod lock notch (14) and the main release control rod intersect notches (24).
Figure 6:
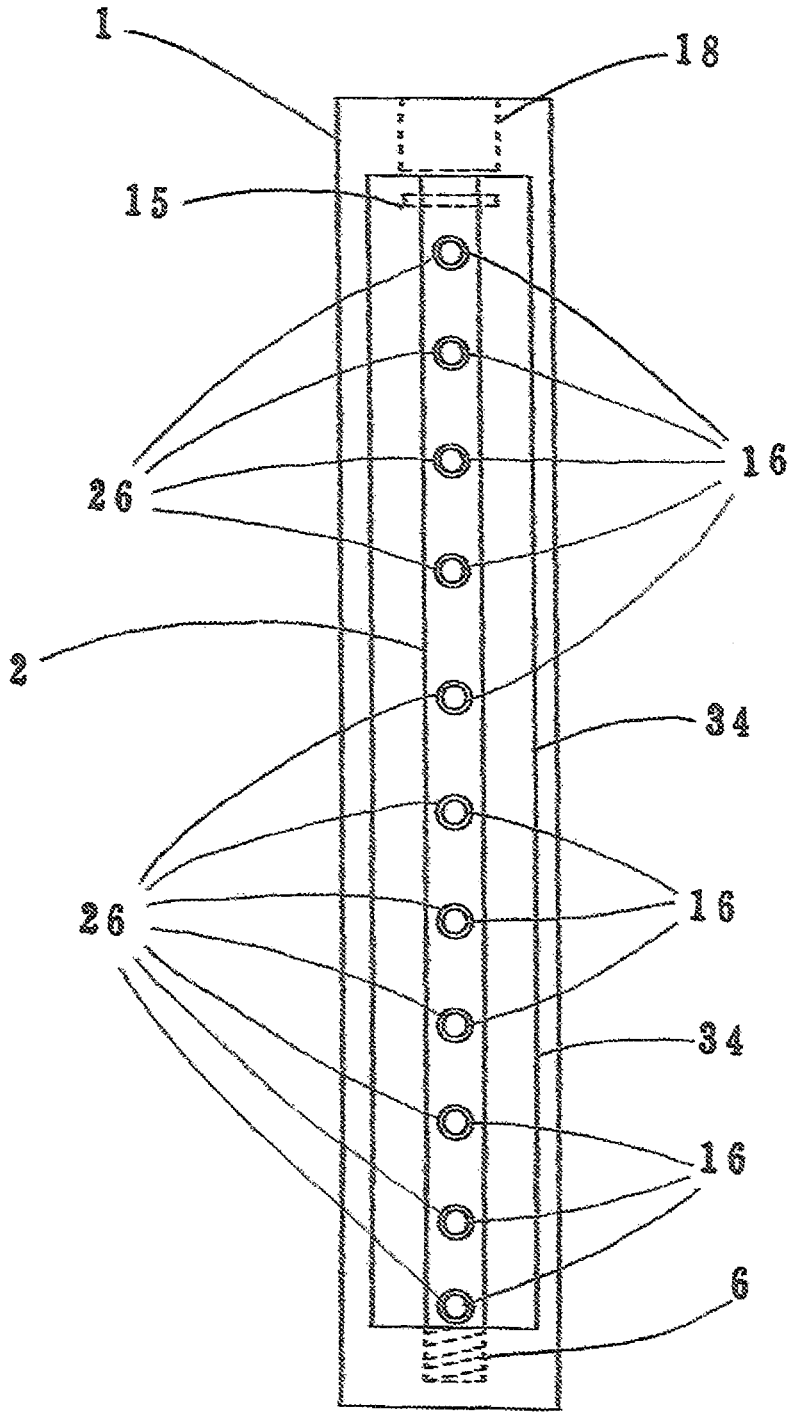
FIG. 6. Is a back side view of the lock-it-socket holder main socket holder body (1) without its back plate (12)

showing recessed push button opening in main body (18) main body control rod lock key notch (15) guide hole for push rods (16) individual push rod hole stepped notch for spring stop in body (26) main control rod slot (2) main spring holder position (6) cut out for back plate on main body (34).

Figure 7:
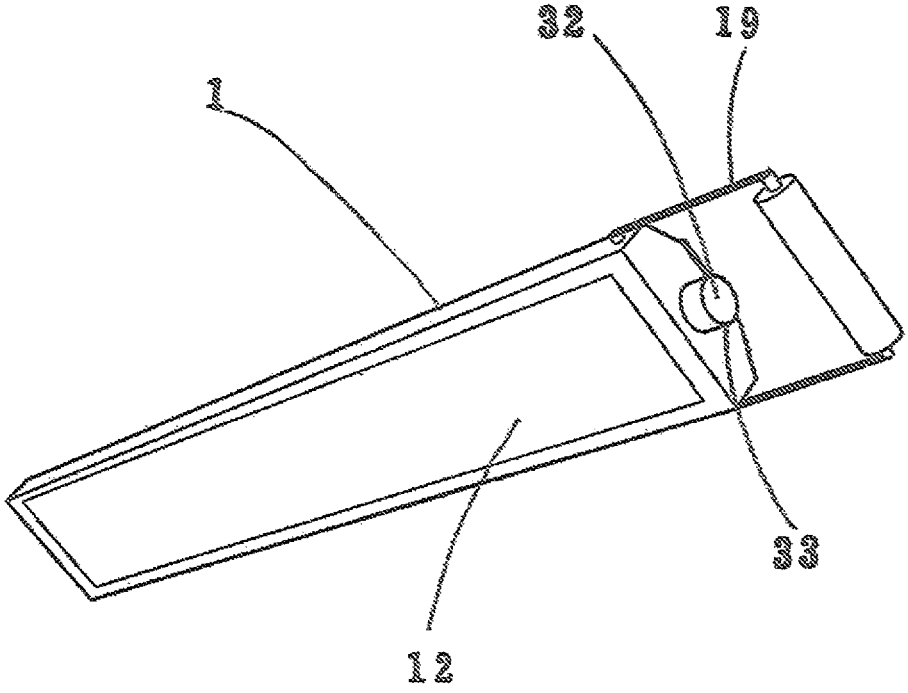

FIG. 7 Is a back side view of the lock-it-socket holder main socket holder body (1) backing, plate (12) handle (19) basic push button (32) basic push button opening on main body (33).

Figure 8:
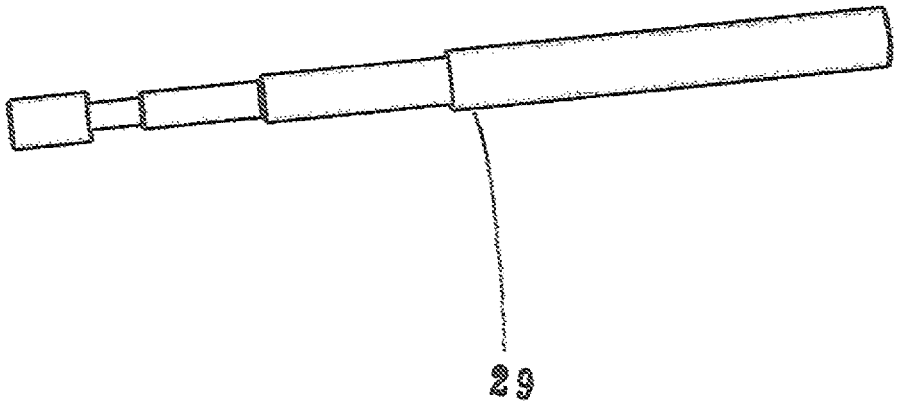

FIG. 8 Is a view of the lock-it-socket holder telescoping magnetic pick up tool (29).

Figure 9:
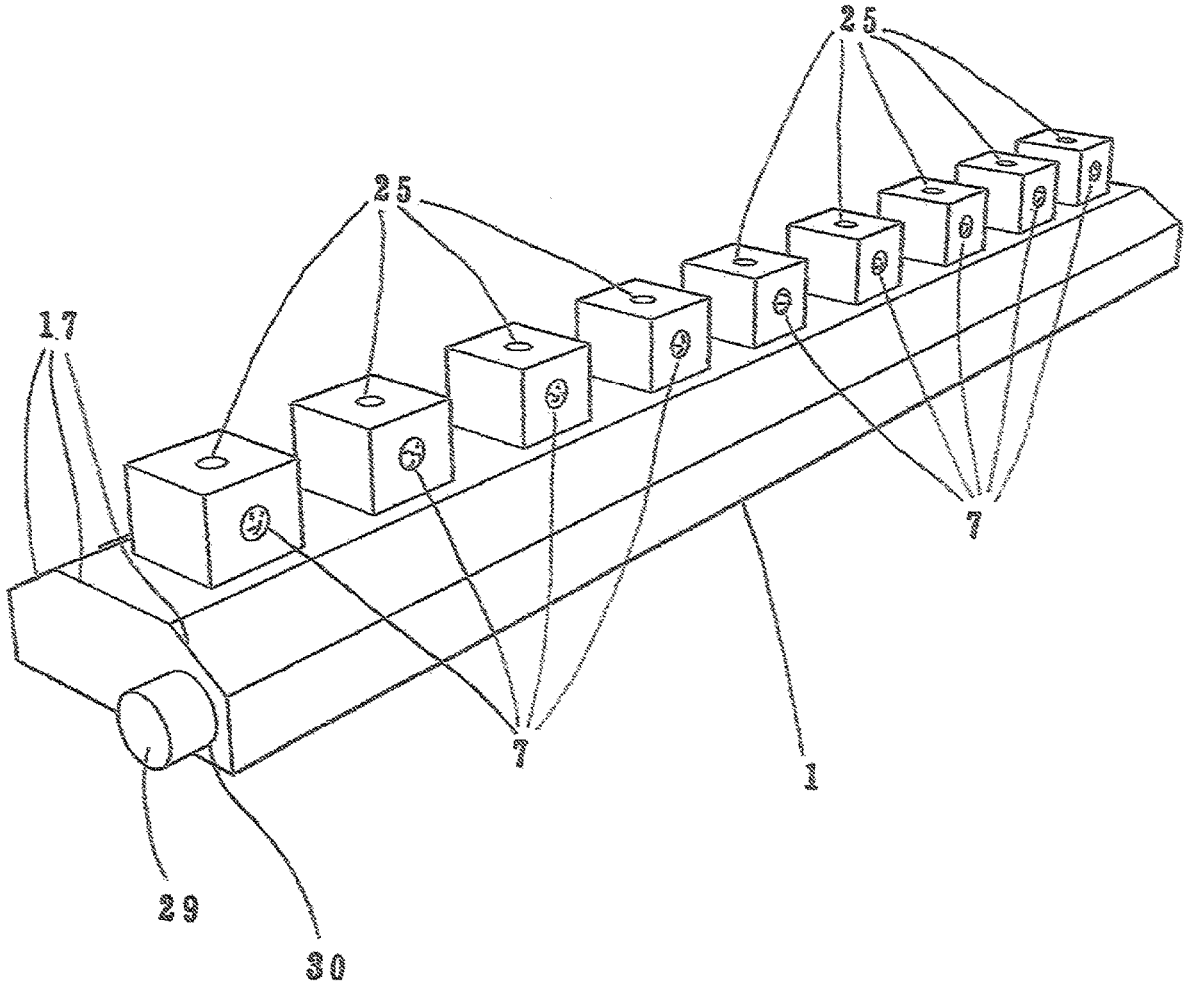

FIG. 9 Is a view of the lock-it-socket holder main socket holder body (1) holding the telescoping magnetic pick up tool (29) in its hole for mounting telescopic magnetic pickup tool in main socket holder body (30) plurality of angled surfaces (17) socket locking ball (7) and push rod relief holes (25).

Figure 10:
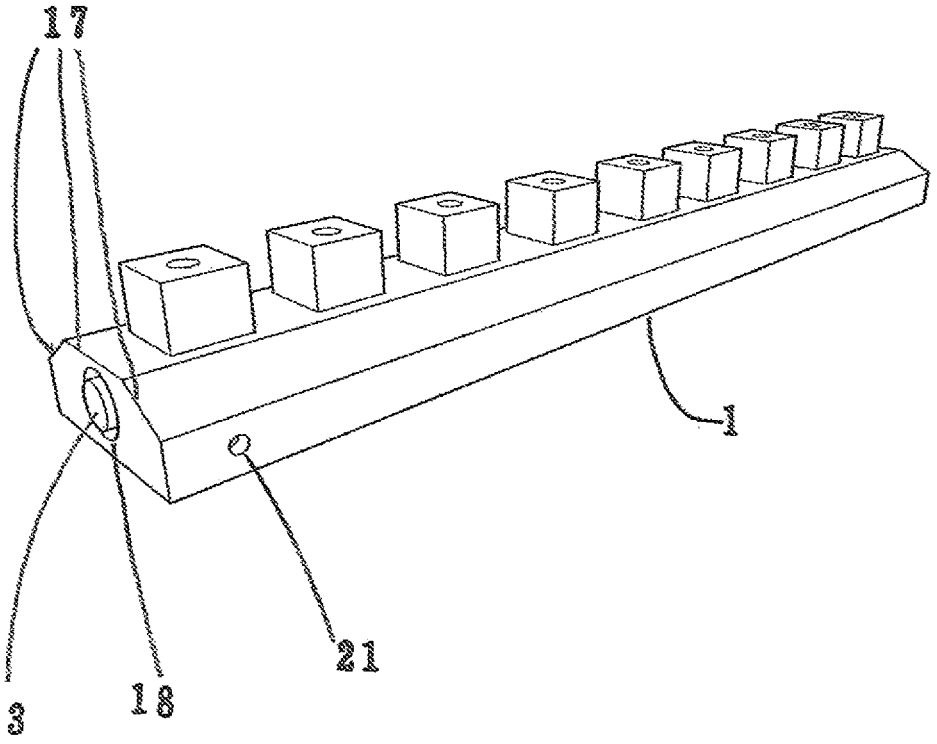

FIG. 10 Is a view of the lock-it-socket holder main socket holder body (1) showing handle mounting holes (21) push button recessed (3) plurality of angled surfaces (17) recessed push button opening in main body (18).

Figure 11:
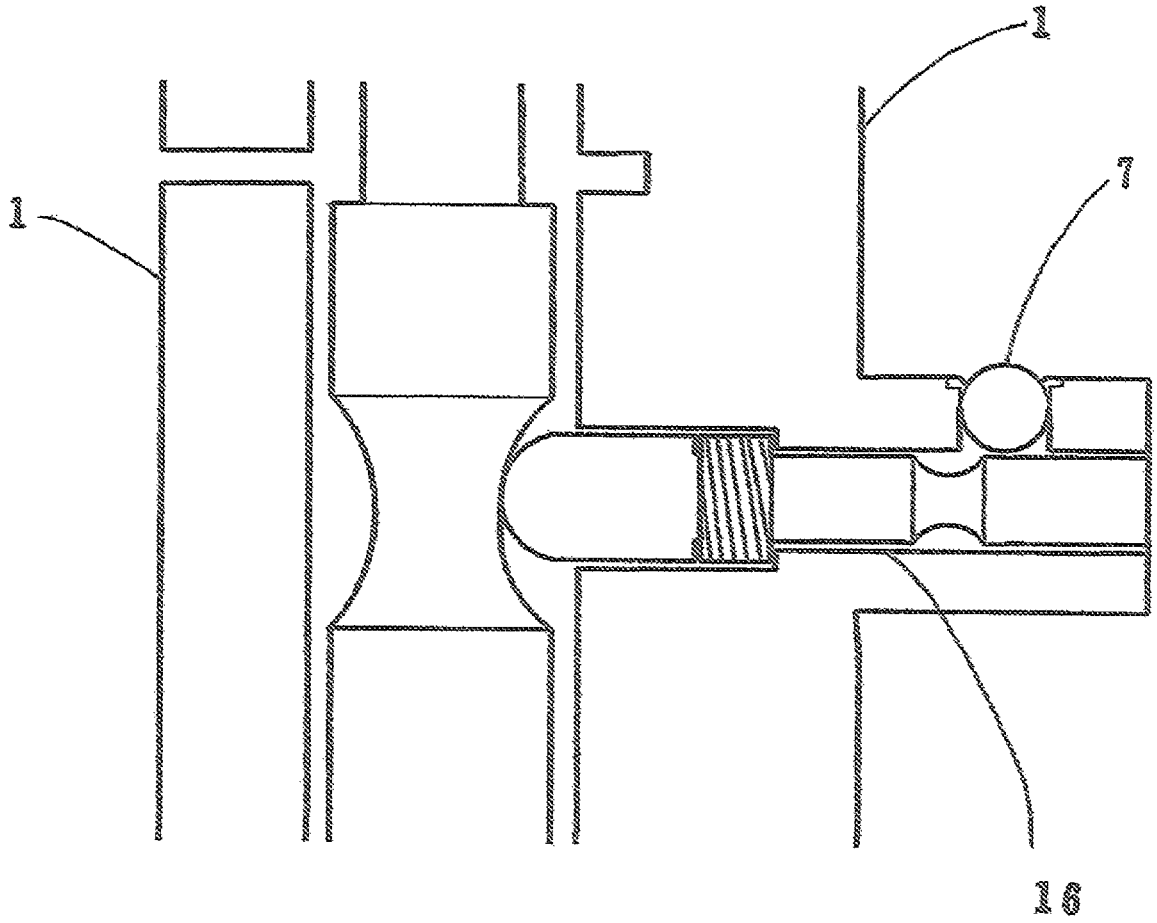

FIG. 11 Is a close up sectional view of the lock-it-socket holder main socket holder body (1) socket locking ball (7) guide hole for push rods (16).

Figure 12:
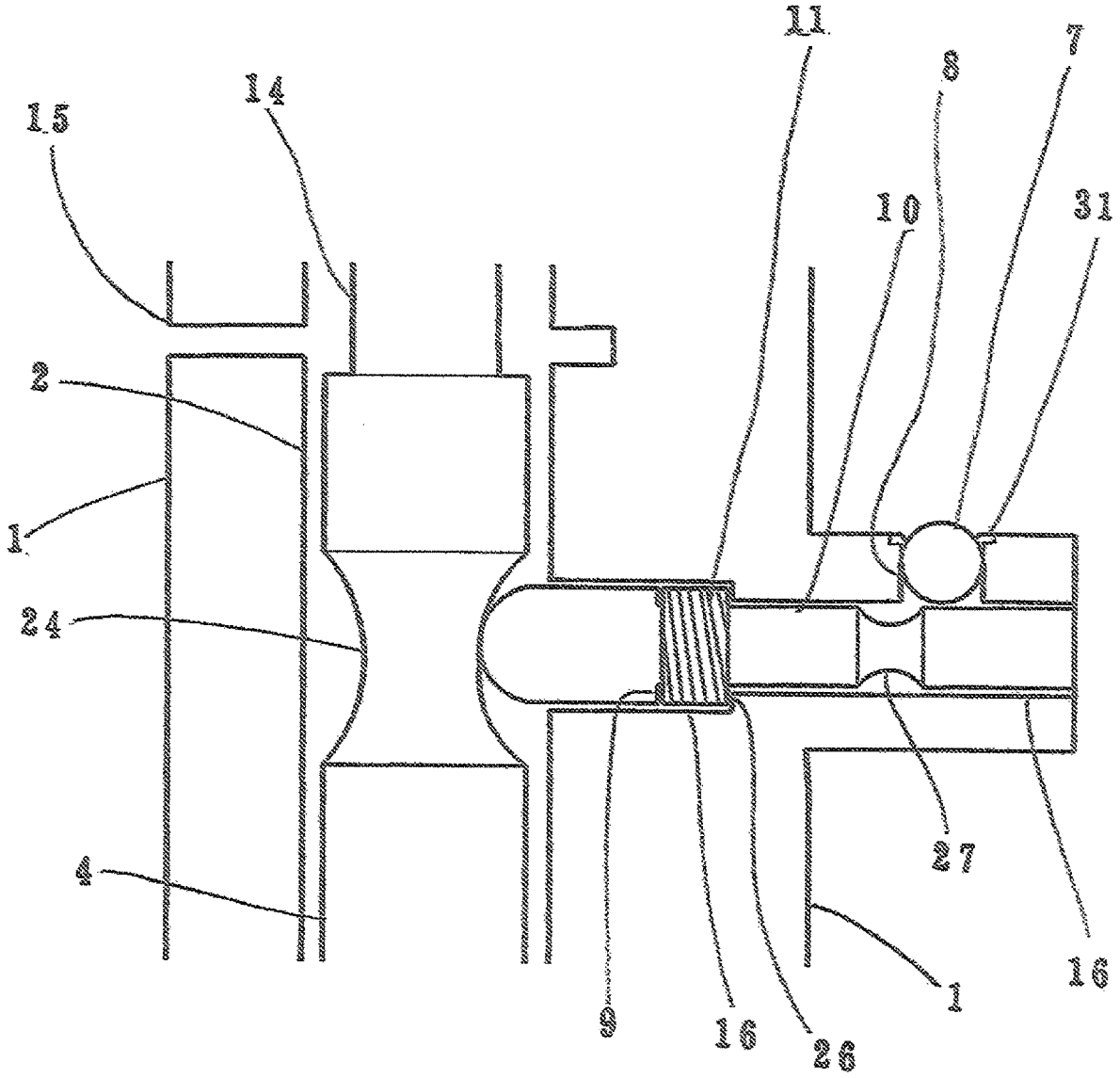

FIG. 12 Is a close up sectional view of the lock-it-socket holder main socket holder body (1) socket locking ball (7) guide hole for push rods (16) push rod spring notch stop (9) individual push rod hole stepped notch for spring stop in body (26) push rods (10) locking ball notch on push, rod (27) socket locking ball (7) socket locking ball hole (8) crimp (31) main release control rod (4) main release control rod intersect notches (24) control rod lock notch (14) main body control rod lock key notch (15) main control rod slot (2).

Figure 13:
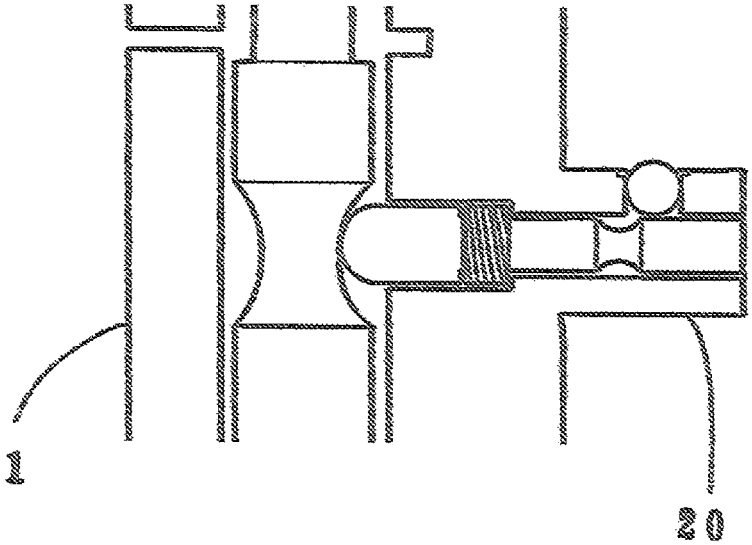

FIG. 13 Is a close up sectional view of the lock-it-socket holder main socket holder body (1) interacting with parts in the socket holder mounting (20).

Figure 14:
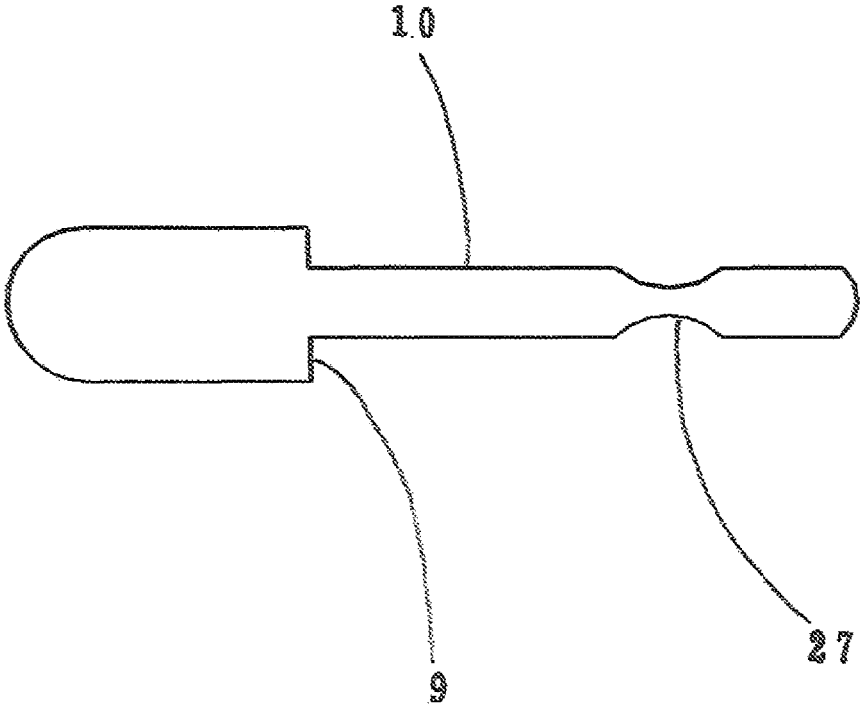

FIG. 14 Is the lock-it-socket holder push rod (10) with its push rod spring notch stop (9) and locking ball notch on push rod (27).

Figure 15:
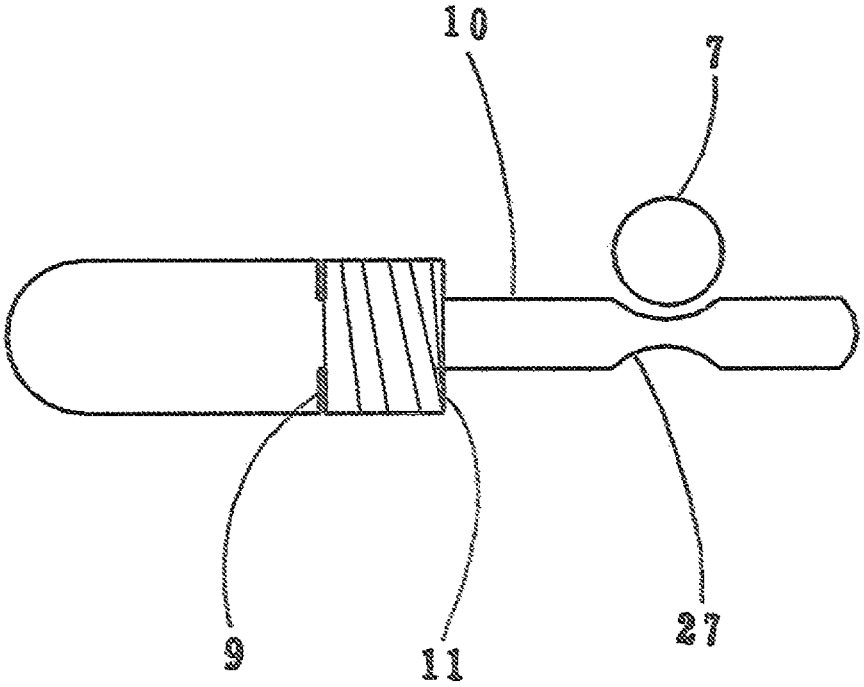

FIG. 15 Is the lock-it-socket holder push rod (10) with its push rod spring notch stop (9) and locking ball notch on push rod (27) individual socket holder push springs (11) and socket locking ball (7).

Figure 16:
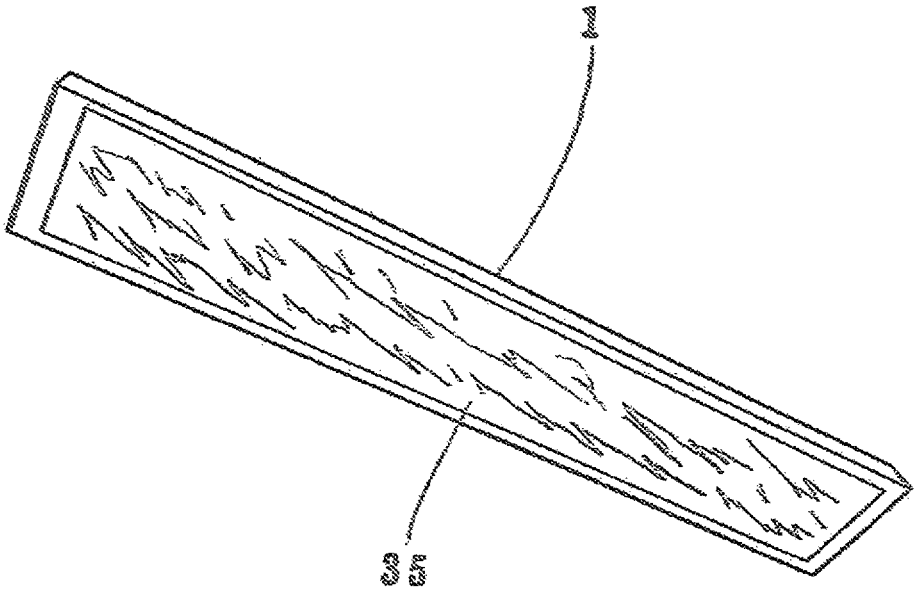

FIG. 16 Is the lock-it-socket holder with its main socket holder body (1) having a magnetic back and plate (35).

Figure 17:
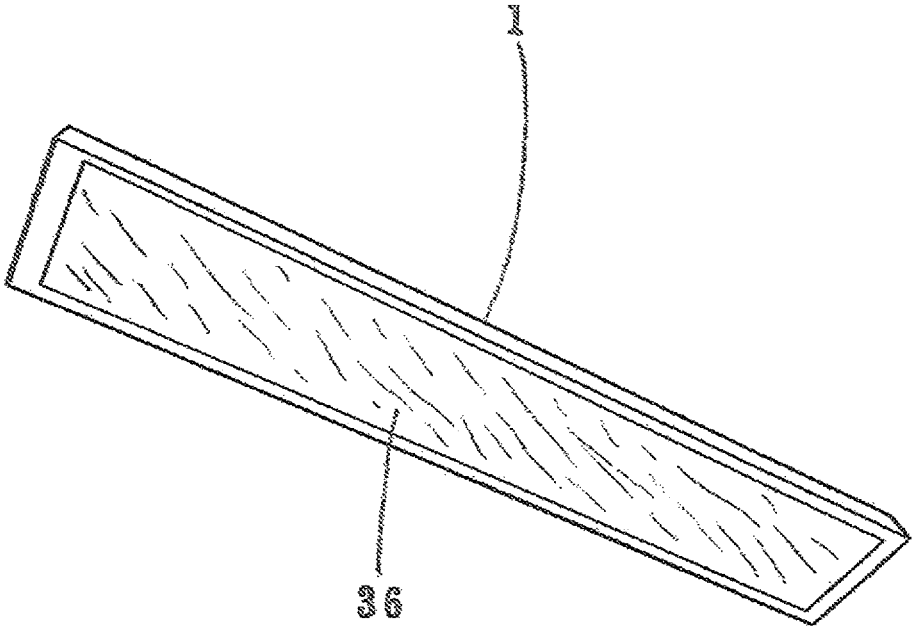

FIG. 17 Is the lock-it-socket holder with its main socket holder body (1) having a resin filled back and plate (36).

Figure 18:
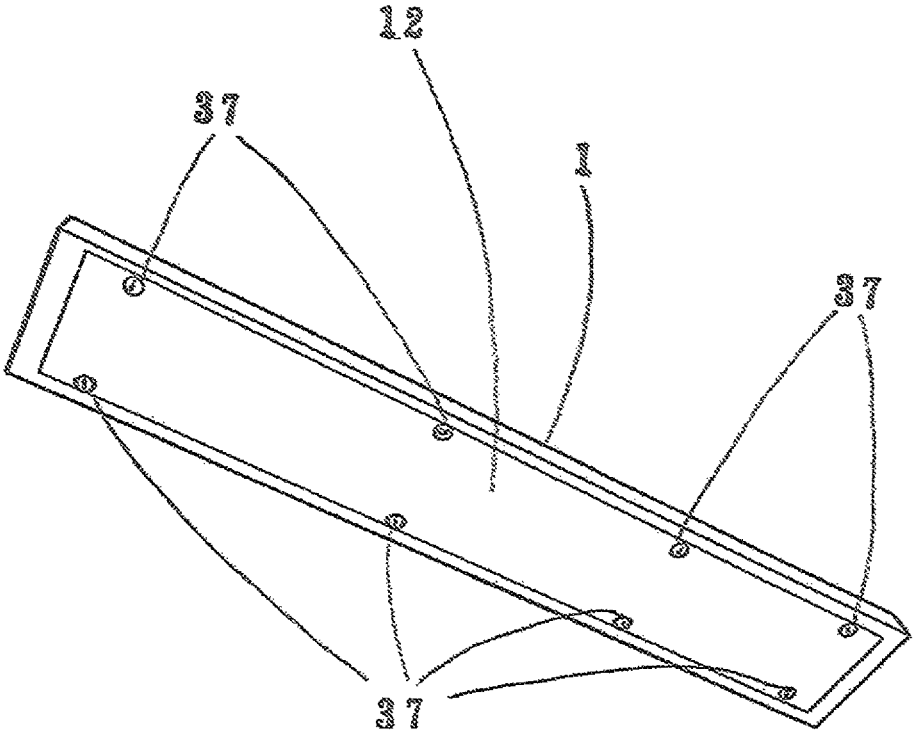

FIG. 18 Is the lock-it-socket holder with its main socket holder body (1) having screws on back plate for installation purposes (37).

PARTS LIST

1. main socket holder body
2. main control rod skit
3. push button recessed
4. main release control rod
5. main spring
6. main spring holder position
7. socket locking ball
8. socket locking ball hole
9. push rod spring notch stop
10. push rods
11. individual socket holder push springs
12. backing plate
13. control rod lock key
14. control rod lock notch
15. main body control rod lock key notch
16. guide hole for push rods
17. plurality of angled surfaces
18. recessed push button opening in main body
19. handle
20. socket holder mountings
21. handle mounting holes
22. socket holder size space markings sae and metric or as desired
23. ruler markings inches and metric
24. main release control rod intersect notches
25. push rod relief hole
26. individual push rod hole stepped notch for spring stop in body
27. locking ball notch on push rod
28. bubble level
29. telescoping magnetic pick up tool
30. hole for mounting telescopic magnetic pickup tool in main socket bolder body
31. crimp
32. basic push button
33. basic push button opening on main body
34. cut out for back plate on main body
35. magnetic back and plate
36. resin filled back and plate
37. screws on back plate for installation purposes
38. multiple release push button body

DETAILED DESCRIPTION OF THE INVENTION

The detailed description of the invention is a tool socket holder herein called the Lock-it-Socket holder. It has a main socket holder body (1) which has individual socket holder mountings (20) that hold sockets onto them with a socket locking ball (7) which is allowed to partially move in and out of the individual socket holder mountings (20) without falling out of the socket locking ball hole (8) by a crimp (31) placed on the outside body edge of the socket locking ball hole (8), this socket locking ball hole (8) intersects with an internal guide hole for push rods (16) where there is found a push rod (10) which has a locking ball notch on push rod (27) that aligns up with the socket locking ball hole (8) when said push rods (10) are moved by the main release control rod (4) located in the control rod slot (2) buy the press of the basic push button (32) or push button recessed (3) which are one of the ends of the main release control rod (4) and its other end goes against a main spring (5) in the main spring holder position (6) in the main socket holder body (1) when the main release, control rod (4) is pressed it allows the main release control rod intersect notches (24) to move the push rods (10) outward into the individual socket holder mountings (20) where the end of the push rods (10) protrude thru the end of the individual socket holder mountings (20) thru a hole called the push rod relief hole (25).

The individual push rod (10) have a push rod spring notch stop (9) that keeps the individual socket holder push spring (11) in its place on the push rod (10) while the guide hole for push rods (16) has in it an enlarged opening in the guide hole for push rods (16) a space for the individual socket holder push spring (11) to compress called the individual push rod hole stepped notch for spring stop in body (26).

The main release control rod (4) has a control rod lock notch (14) that intersects with a main body control rod lock key notch (15) that has placed in it a control rod lock key (13) which is held place by a backing plate (12).

The main release control rod (4) is placed in a main control rod slot (2) in the main socket holder body (1) where it can move the internal push rods (10) to compress the individual socket holder push springs (11) in the guide hole for push rods (16) which allow the socket locking ball (7) in the socket locking ball hole (8) to move creating the locking hold and release action on sockets being held onto the individual socket holder mountings (20) while the main release control rod (4) is also on the end opposite of its push button end (32 or 3) is compressing against the main spring (5) in the main spring holder position (6) while it is moving the outer ends of the push rods (10) through the push rod relief hole (25).

When the main release control rod (4) push button end is released (32 or 3) it goes back up thru the main socket holder body (1) thru the push button openings at either (33 or 18) and the individual socket holder push springs (11) and the main spring (5) move all of the internal moving parts and the main release control rod (4) back to their original positions with the socket locking ball (7) being in the outward socket locking hold position in the socket locking ball hole (8) with the crimp (31) on the socket locking ball hole (8) keeping the socket locking ball (7) from falling out of the socket locking ball hole (8) as the push rod (10) pushes the socket locking ball (7) outward in the socket locking ball hole (8) with the force of the compressed individual socket holder push springs (11) pushing the push rods (10) back into the guide hole for push rods (16) making the locking ball notch on push rod (27) move and lift socket locking ball (7) back up in the socket locking ball hole (8) while the end of the push rods (10) move inward against the main release control rod (4) at its main release control rod intersect notches (24) and bring the ends of the push rods (10) back into the push rod relief hole (25).

The control rod lock key (13) in the main body control rod lock key notch (15) will intersect the control rod lock notch (14) keeping said main release control rod (4) from coming out of the main socket holder body (1) while also aligning all of the parts internal and external until the next press of the main release control rod (4) at its push button end (32 or 3).

The main socket holder body (1) can have a handle (19) with handle mounting holes (21), along with a plurality of angled surfaces (17) that can have socket holder size space markings sae and metric or as desired (22) on them next to their individual socket holder mountings (20) allowing for precise placement of sockets back onto the main socket holder body (1) also on these plurality of angled surfaces (17) can be placed on each side ruler markings inches and metric (23).

The main socket holder body (1) can have a bubble level (28) and a telescoping magnetic pickup tool (29) mounted into a hole for mounting telescopic magnetic tool in main socket holder body (30).

The main socket holder body (1) can have a backing plate (12) with screws on the back plate for installation purposes (37) or it can have a magnetic back and plate (35) with screws on the back plate for installation purposes (37).

The main socket holder body (1) can have a cutout for back plate on main body (34) that would allow for having a backing plate (12) to fit into a recessed opening created by the cutout for back plate on main body (34) where the backing plate (12) can have screws on back plate for installation purposes (37) or have a resin filled back and plate (36) permanently sealing the back onto the main socket holder body (1) or have a magnetic back and plate (35) with screws on back plate for installation purposes (37) or just the have a backing plate (12) with screws on back plate for installation purposes (37) in the recessed opening created by the cutout for back plate on main body (34).

Also the main socket holder body (1) can be made alternatively as a multiple release push button body (38) unit having multiple push button releases (3 or 32) and multiple rows of individual socket holder mountings (20) with various sized socket drives as in Example: ¼", ⅜", ½" socket drives etc. on its multiple release push button body (38) on its individual socket holder mountings (20) of which said multiple release push button body (38) can also be of any length desired; so also can be said about the single rowed socket holders main socket holder body (1) of being of any length desired and having various multiple sized socket drives on its main socket holder body (1) as in Example: ¼", ⅜", ½" socket drives etc. also can be made onto its main socket holder body (1) onto each of its individual socket holder mountings (20).

The invention claimed is:

1. An apparatus for holding and releasing tools having a socket drive connection fitting, the apparatus comprising: a main socket holder body (1) having a plurality of socket holder mountings (20), with each having a socket locking ball (7) in a socket locking ball hole (8) which has a crimp (31) to hold the socket locking ball (7) in the respective socket locking ball hole (8), a guide hole for push rods (16) including a push rod (10) that has a push rod spring notch stop (9) that the push rod (10) has that holds an individual socket holder push spring (11) in position on the push rod (10) so when it moves into the guide hole for push rods (16) the individual socket holder push spring (11) is compressed against an individual push rod hole stepped notch for spring stop in main body (26) allowing the push rod (10) to have a limited movement space in which to move outward thru the individual socket holder mountings (20) thru a push rod relief hole (25) which movement will allow a locking ball notch on push rod (27) to move into an alignment position with the socket locking ball (7) to drop into the socket locking ball hole (8) creating hold or release action on the individual socket holder mountings (20) as the socket locking ball (7) moves in and out of the socket locking ball hole (8), so that when the push rod (10) that is located in the guide hole for push rods (16) meets a main release control rod (4) located in the main socket holders body (1) in a main control rod slot (2) where the main release control rod (4) has its range of movement motion set and is also held in the main socket holder body (1) by a control rod lock key (13) that is placed in a main body control rod lock key notch (15) where it can then intersect with the main release control rod (4) in a cutout section called a control rod lock notch (14) where the control rod lock key (13) intersects with the control rod lock notch (14) and is held securely in the main body control rod lock key notch (15) by a backing plate (12), the main release control rod (4) has as one of its ends to be a basic push button (32) end and another end of the main release control rod (4) is resting against a main spring (5) located in a main spring holder position (6) inside of the main socket holder body (1) where it serves its purpose of pushing the main release control rod (4) back up into an original position after the basic push button (32) end has been pressed downward into the main socket holder body (1) into a basic push button opening on main body (33) where the basic push button (32) end has space to move downward which allows the main release control rod (4) when pressed downward to intersect with the push rods (10), such that the main release control rod intersect notches (24) of the main release control rod (4) intersect with and move the push rods (10), which are inside the guide holes for push rods (16) having the individual socket holder push springs (11) on the push rods (10) being compressed between the push rod spring notch stop (9) on the push rods with the individual push rod hole stepped notch for spring stop in main body (26) allowing space for the locking ball notch on push rod (27) to line up with the socket locking ball hole (8) allowing socket locking ball (7) to go into the socket locking ball hole (8) while an end of the push rods (10) go through the push rod relief hole (25) and then when the push button exposed (32) end is released the main spring (5) located in the main spring holder position (6) along with the individual socket holder push springs (11) work together pushing the respective push rods (10) back into original positions while also moving the respective socket locking balls (7) back into their original socket holding positions on each of the individual socket holder mountings (20) while the main release control rod (4) which has as one of its ends as the basic push button (32) end having been released also goes back into an original position releasing force against all of the push rods (10).

2. The apparatus of claim 1, wherein said main socket holder body (1) has the push button (32) end going into a recessed push button opening in main body (18) on said main socket holder body (1).

3. The apparatus of claim 1, wherein said main socket holder body (1) has a plurality of angled surfaces (17).

4. The apparatus of claim 2, wherein said main socket holder body (1) has a plurality of angled surfaces (17).

5. The apparatus of claim 3, wherein said angled surfaces (17) on said main socket holder body (1) have socket holder size space markings in the form of at least one of SAE and metric markings (22).

6. The apparatus of claim 3, wherein said angled surfaces (17) on said main socket holder body (1) have ruler markings inches and metric (23).

7. The apparatus of claim 1, wherein said main socket holder body (1) has handle mounting holes (21) and a handle (19).

8. The apparatus of claim 1, wherein said main socket holder body (1) has a cut out for back plate on main body (34).

9. The apparatus of claim 1, wherein said main socket holder body (1) have a screws on back plate for installation purposes (37).

10. The apparatus of claim 1, wherein said main socket holder body (1) has a magnetic back and plate (35).

11. The apparatus of claim 1, wherein said main socket holder body (1) has a resin filled back and plate (36).

12. The apparatus of claim 1, wherein said main socket holder body (1) has a bubble level (28).

13. The apparatus of claim 1, wherein said main socket holder body (1) has a telescoping magnetic pickup tool (29) and a hole for mounting telescopic magnetic pickup tool in said main socket holder body (30).

14. The apparatus of claim 1, wherein said main socket holder body (1) has at least one additional main release control rod (4) controlling a plurality of additional push rods (10 or 13) and a plurality of additional socket holder mountings (20).

* * * * *